US010132068B2

(12) United States Patent
Bogard et al.

(10) Patent No.: US 10,132,068 B2
(45) Date of Patent: Nov. 20, 2018

(54) URINAL SPREADER ASSEMBLY

(71) Applicant: Kohler Co., Kohler, WI (US)

(72) Inventors: Douglas E. Bogard, Kohler, WI (US); Kyle L. Hokel, Sheboygan Falls, WI (US); Peter Kajuch, Brookfield, WI (US)

(73) Assignee: KOHLER CO., Kohler, WI (US)

( * ) Notice: Subject to any disclaimer, the term of this patent is extended or adjusted under 35 U.S.C. 154(b) by 616 days.

(21) Appl. No.: 14/340,097

(22) Filed: Jul. 24, 2014

(65) Prior Publication Data

US 2015/0026874 A1 Jan. 29, 2015

Related U.S. Application Data

(60) Provisional application No. 61/858,507, filed on Jul. 25, 2013.

(51) Int. Cl.
*E03D 13/00* (2006.01)

(52) U.S. Cl.
CPC ..... *E03D 13/00* (2013.01)

(58) Field of Classification Search
CPC ..... E03D 13/00; B05B 1/14; B05B 1/20
USPC ..... 4/301; 239/556, 602, DIG. 12
See application file for complete search history.

(56) References Cited

U.S. PATENT DOCUMENTS 639,971 A 12/1899 Griffiths
703,651 A 7/1902 Griffiths
1,543,009 A * 6/1925 Hedges ..... B05B 1/044 239/451
1,582,488 A 4/1926 Sherwood
5,224,222 A 7/1993 Jones
5,318,498 A 6/1994 Jones
5,499,405 A 3/1996 Collins
5,819,331 A 10/1998 Miuccio
6,789,749 B2 9/2004 Liu
7,908,680 B2 3/2011 Akitsu
7,962,973 B2 6/2011 Sikirov
7,971,284 B2 7/2011 Pessel et al.
2004/0164184 A1* 8/2004 Glunk ..... B05B 1/185 239/533.14
2006/0236445 A1 10/2006 Lee
(Continued)

FOREIGN PATENT DOCUMENTS

JP 08239889 A * 9/1996
JP 2007321543 A * 12/2007
(Continued)

OTHER PUBLICATIONS

English machine translation of Higuchi JP 2-7-321543 A dated Apr. 20, 2017.*

(Continued)

*Primary Examiner* — Christine Skubinna
(74) *Attorney, Agent, or Firm* — Foley & Lardner LLP

(57) ABSTRACT

A urinal is disclosed as having a spreader assembly. The spreader assembly includes a spreader body that may be mounted to the urinal, and a spreader mat. The spreader mat includes a series of spray holes. The spreader body is connected to a water supply, and a perimeter of the spreader mat is sealed to the spreader body. Each spray hole of the spreader mat is oriented to direct water onto a particular area of the urinal, when water is supplied to flush the urinal.

19 Claims, 15 Drawing Sheets

(56) References Cited

U.S. PATENT DOCUMENTS

| | | | |
|---|---|---|---|
| 2007/0125885 | A1 | 6/2007 | Daly et al. |
| 2007/0245474 | A1 | 10/2007 | Nakladal |
| 2008/0052810 | A1 | 3/2008 | Zeeb et al. |
| 2010/0154107 | A1 | 6/2010 | Wu |
| 2010/0192292 | A1 | 8/2010 | Miyagi et al. |
| 2011/0088153 | A1 | 4/2011 | Richard et al. |
| 2011/0308001 | A1 | 12/2011 | Almabekov |

FOREIGN PATENT DOCUMENTS

| | | | | |
|---|---|---|---|---|
| JP | 5126740 | B2 | * | 1/2013 |
| WO | WO2013/005865 | A1 | | 10/2013 |

OTHER PUBLICATIONS

Derwent English abstract of JP 5126740 B2 dated Mar. 11, 2018.*
Derwent English abstract of JP 08239889 A dated Mar. 11, 2018.*

* cited by examiner

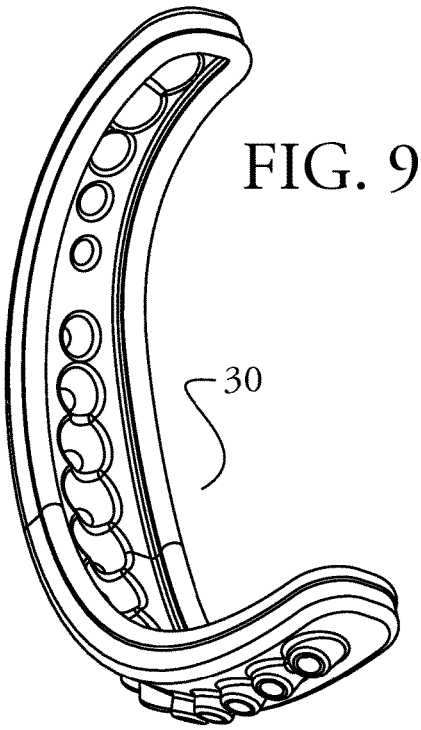
FIG. 9
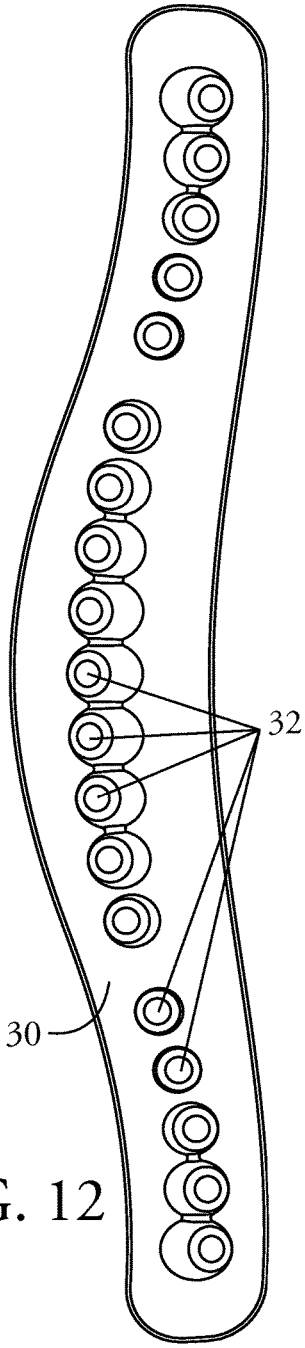
FIG. 12
FIG. 11
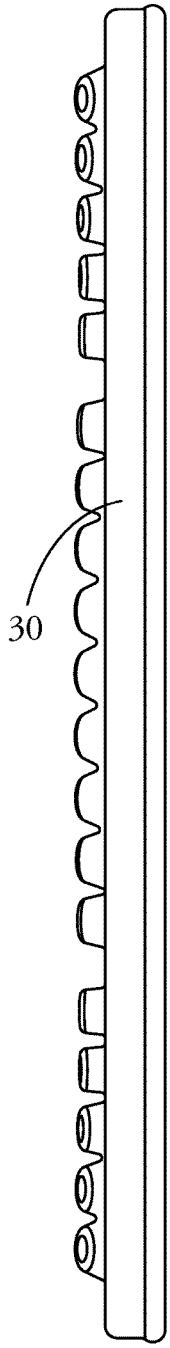

FIG. 18
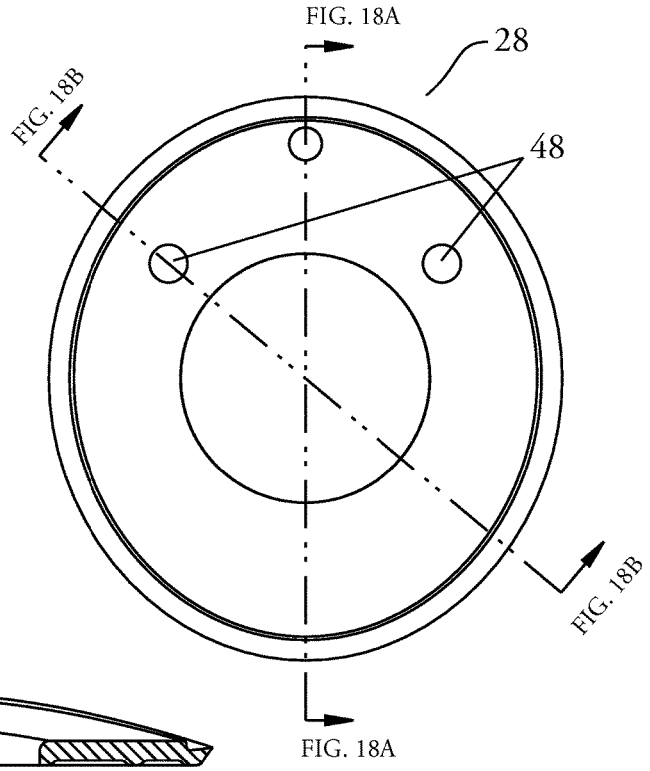
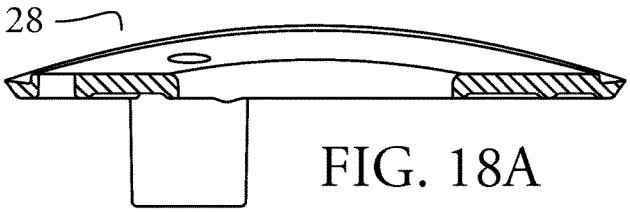
FIG. 18A
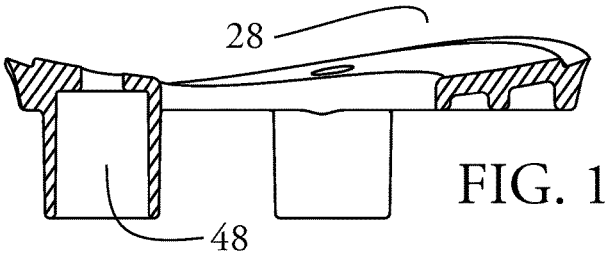
FIG. 18B

URINAL SPREADER ASSEMBLY

CROSS-REFERENCE TO RELATED PATENT APPLICATIONS

This application claims priority from U.S. Provisional Application No. 61/858,507, filed on Jul. 25, 2013, incorporated herein by reference in its entirety.

BACKGROUND

This application relates generally to the field of urinals having a spreader used to disperse water into the basin of the urinal during a flushing cycle. More particularly, this application relates to an improved spreader assembly for a urinal which is configured to direct water to specific areas of a particular urinal.

There are generally two types of urinals: those that use water to flush the fixture after each use, and waterless urinals which do not use water to flush the fixture. Urinals that use water as part of a flushing cycle typically include a flush valve mounted above a basin (e.g., a bowl, plumbing enclosure, plumbing fixture, etc.). Flush valves are typically used with urinals to control how much water is delivered to the urinal during a flush cycle. An inlet of the flush valve may be fluidly connected to a municipal water supply, and an outlet of the flush valve may be fluidly coupled to a urinal spreader. Urinal spreaders are generally mounted within a hole near the top of the fixture, so that flush water may flow down over the surface of the fixture and wash urine toward a drain. Generally, these spreaders include a slot, and water enters the fixture through the slot during a flush cycle. These spreader configurations that include such slots have several disadvantages, only some of which are disclosed herein.

First, the slots of these urinal spreaders may direct water in a general direction towards the basin of a urinal. However, these slots generally do not direct a particular amount of water to a particular location. This is disadvantageous for at least two reasons: the basin may not be thoroughly washed by the spreader, and the configuration of these urinal spreaders may necessitate the use of more flush water than is actually needed to wash the basin of a urinal.

Second, urinal spreaders are generally manufactured (e.g., cast, molded, etc.) from expensive materials (e.g., brass and other metals) as an integral (e.g., single, uniform, etc.) part. However, urinals come in many shapes and sizes. The surfaces of basins of various urinals may have different widths, heights, contours, slopes, etc. In view of the wide selection of urinals in the marketplace, a typical urinal spreader that is manufactured as a single piece may not necessarily be able to direct a useful amount of water to the basin of a particular urinal.

Thus, it would be advantageous to provide a urinal spreader assembly that is configured to direct an adequate amount of water to particular areas of a particular urinal. It would also be advantageous to provide a urinal spreader assembly that includes a feature, such as a sprayer mat, which is interchangeable within the spreader assembly and can be configured for the basin of a particular urinal.

SUMMARY

One exemplary embodiment relates to a urinal having a spreader assembly. The spreader assembly includes a body configured to be coupled to the urinal, and a mat. The mat includes a plurality of spray holes. The body is configured to be fluidly coupled to a water supply, and a perimeter of the mat is configured to be sealingly coupled to the body. Each spray hole is oriented to direct water onto a particular area of the urinal, when water is supplied to flush the urinal.

Another exemplary embodiment relates to a spreader assembly for a urinal. The spreader assembly includes a body and a mat having a plurality of spray holes. The body is configured to be fluidly coupled to a water supply, and a perimeter of the mat is configured to be sealingly coupled to the body. Each spray hole is configured to direct water onto a particular area of the urinal, when water is supplied to flush the urinal.

Another exemplary embodiment relates to a spreader assembly for a urinal that includes a body having a groove, a mat having a lip configured to engage the groove and a plurality of apertures configured to disperse water in a predetermined pattern, and a cover configured to retain the mat position on the body.

BRIEF DESCRIPTION OF THE DRAWINGS

FIG. 9 is a perspective view of a sprayer mat of the spreader assembly shown in FIG. 4, according to an exemplary embodiment.

FIG. 11 is a side view of the sprayer mat shown in FIG. 10.

FIG. 12 is a front view of the sprayer mat shown in FIG. 10.

FIG. 18 is a front view of the back piece shown in FIG. 16.

FIG. 18A is a cross-sectional view of the back piece shown in FIG. 18.

FIG. 18B is another cross-sectional view of the back piece shown in FIG. 18.

DETAILED DESCRIPTION

Referring generally to the FIGURES disclosed herein is an exemplary embodiment for a spreader assembly for a urinal which is configured to deliver water to particular areas of a urinal. The spreader assembly includes a sprayer mat comprising multiple spray holes, each of which are oriented toward a particular area of a urinal basin when the spreader assembly is installed within a urinal.

Figure 1:
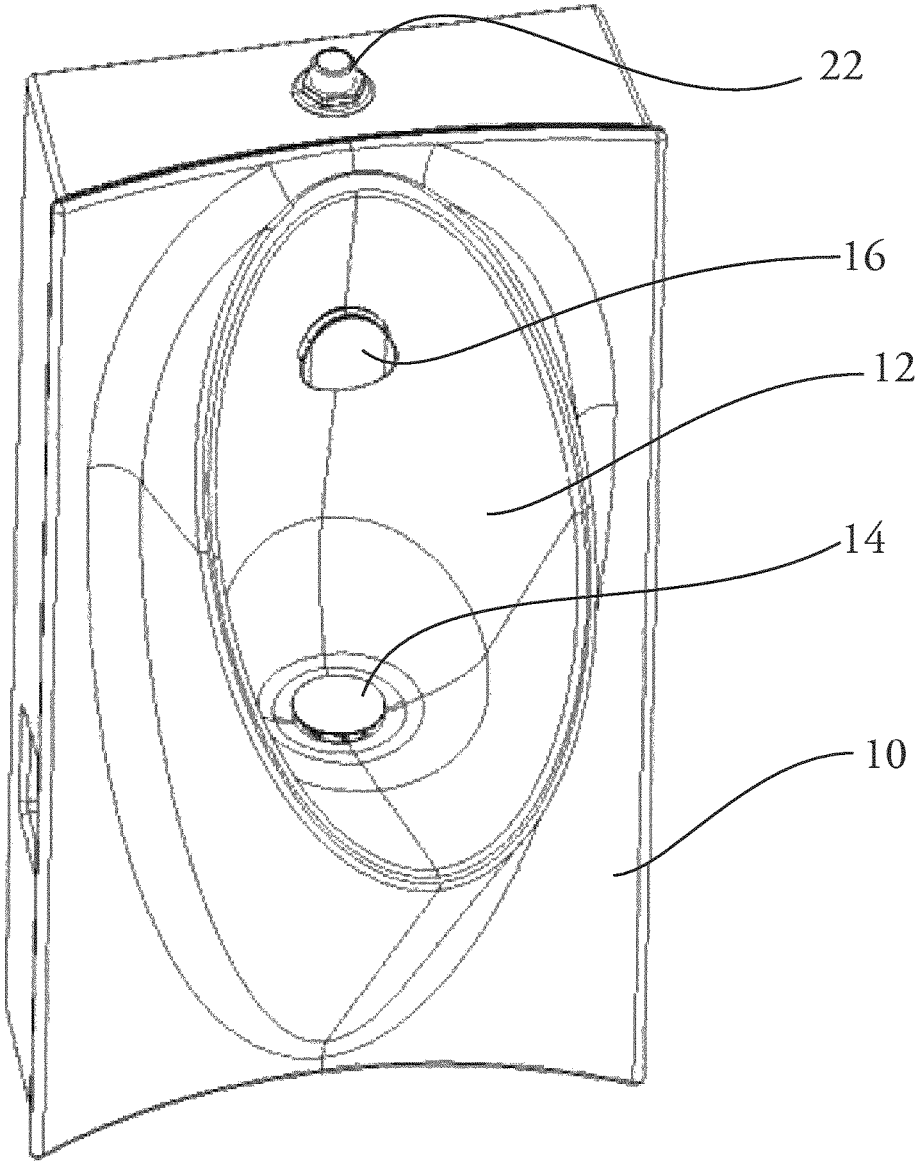
FIG. 1 is a perspective view of a urinal, and a urinal spreader assembly mounted thereto, according to an exemplary embodiment.
Figure 2:
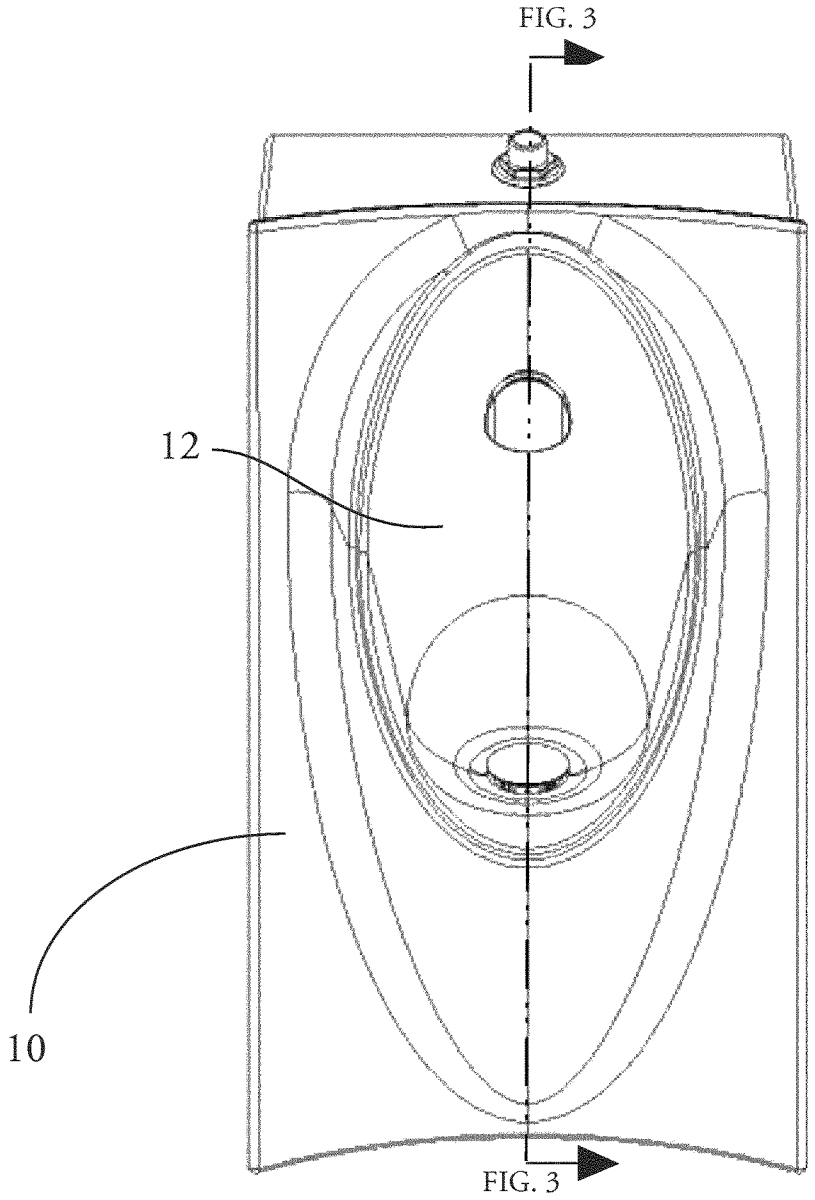
FIG. 2 is another perspective view of the urinal and the urinal spreader assembly shown in FIG. 1.

FIGS. 1-2 illustrate an exemplary embodiment of a urinal 10 including a basin (i.e., a bowl, plumbing enclosure, etc.) 12 that is used to receive a fluid (e.g., urine), a drain 14 through which the fluid and flush water exits the basin 12, a flush valve (not shown) which regulates the amount of water used for a flush cycle, and a spreader assembly 16 which is fluidly coupled to the flush valve to distribute (e.g., spread, disperse, etc.) water over the urinal surface in a desired pattern or profile. As shown, the spreader assembly 16 is positioned near a top portion of the basin 12, preferably within the top half of the basin 12, so that the flush water supplied by the spreader assembly 16 is able to wash down and over most of the basin 12. As shown, the spreader assembly 16 may be positioned within the basin 12 so that it is visible to a user. Alternatively, the spreader assembly 16 may be positioned within the basin 12 so that it is generally not visible to a user (e.g., from the perspective of a user standing directly in front of the urinal). For example, the spreader assembly 16 may be positioned near a top portion of the basin 12, and behind a forward rim (not shown) of the basin 12.

Figure 3:
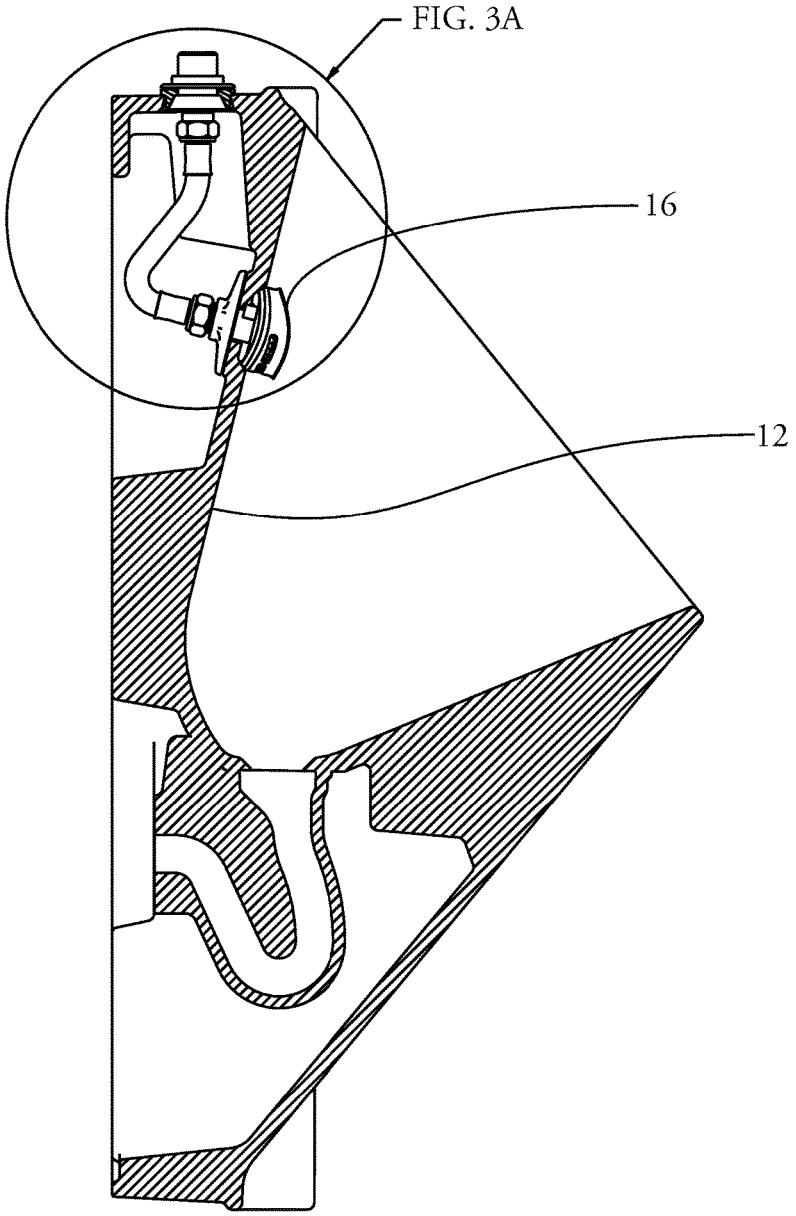
FIG. 3 is a cross-sectional view of the urinal and the urinal spreader assembly shown in FIG. 2.
Figure 3A:
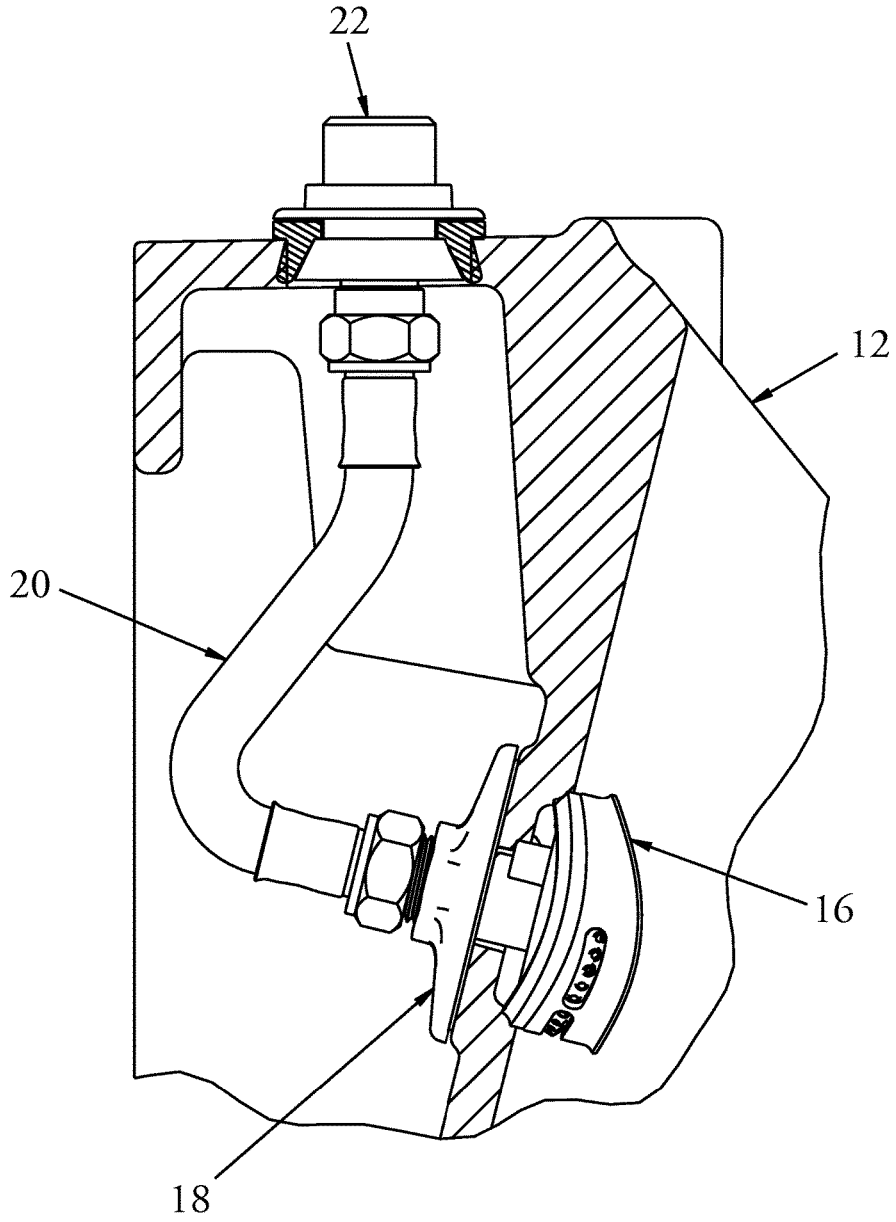
FIG. 3A is a detail view of the spreader assembly mounted within the urinal shown in FIG. 3, according to an exemplary embodiment.

FIGS. 3 and 3A illustrate an exemplary embodiment of how the spreader assembly 16 may be mounted to the urinal 10. A mounting hole may be disposed within (e.g., extend through) a rear wall of the basin 12. As shown, a rear portion of the spreader assembly 16 is received within such a hole. A fastener, such as the threaded nut 18, is used on an opposite side of the rear wall of the basin 12 to couple (e.g., fasten, connect, secure, etc.) the spreader assembly 16 to the basin 12. It is noted that while the threaded nut 18 is disclosed as fastening the spreader assembly 16 to the basin 12, a spreader assembly may be coupled to a urinal in other ways, according to other exemplary embodiments, and the exemplary embodiments disclosed herein are not limiting. For example, according to another exemplary embodiment, a hole disposed with a rear wall of a basin may be threaded, and a spreader assembly may be secured to the threaded hole. According to yet another exemplary embodiment, an adhesive may be used to couple a spreader assembly to a basin.

Referring still to FIGS. 3 and 3A, according to an exemplary embodiment, a first end 20A of a hose 20 is coupled (i.e., connected, attached, threaded, fastened, secured, etc.) to a rear portion of the spreader assembly 16 which extends through the rear wall of the basin 12. A second end 20B of the hose 20 is coupled to a plumbing fitting 22 that is coupled to a flush valve (not shown), thereby fluidly coupling the spreader assembly 16 to the flush valve. Therefore, when the flush valve is actuated by a user, water from a municipal water line (not shown) may flow through the flush valve. the hose 20, and into the spreader assembly 16. Although the second end 20B of the hose 20 is shown as being coupled to a plumbing fitting 22 on top of the urinal 10, it should be understood that a flush valve may be mounted within a rear wall. In addition, a sensor may be coupled to the wall, and a flush valve may be actuated when a user leaves the proximity of the urinal. Alternatively, an actuator (e.g., a button) may be coupled to the wall, and a flush valve may be actuated when a user presses the actuator.

Figure 4:
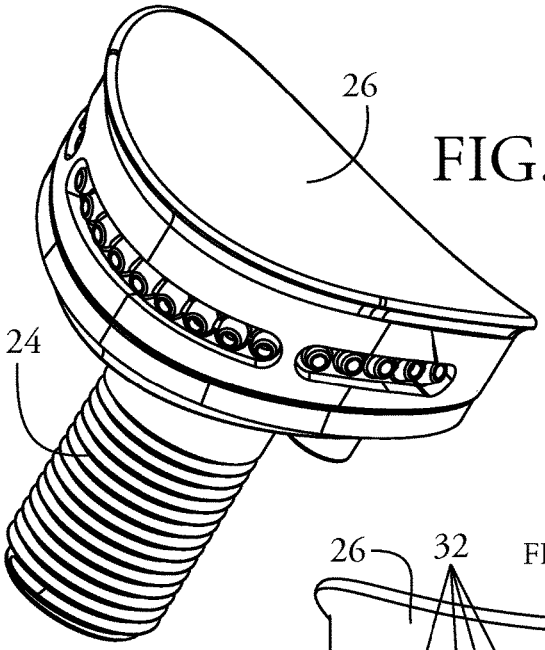
FIG. 4 is a perspective view of a urinal spreader assembly, according to an exemplary embodiment.
Figure 5:
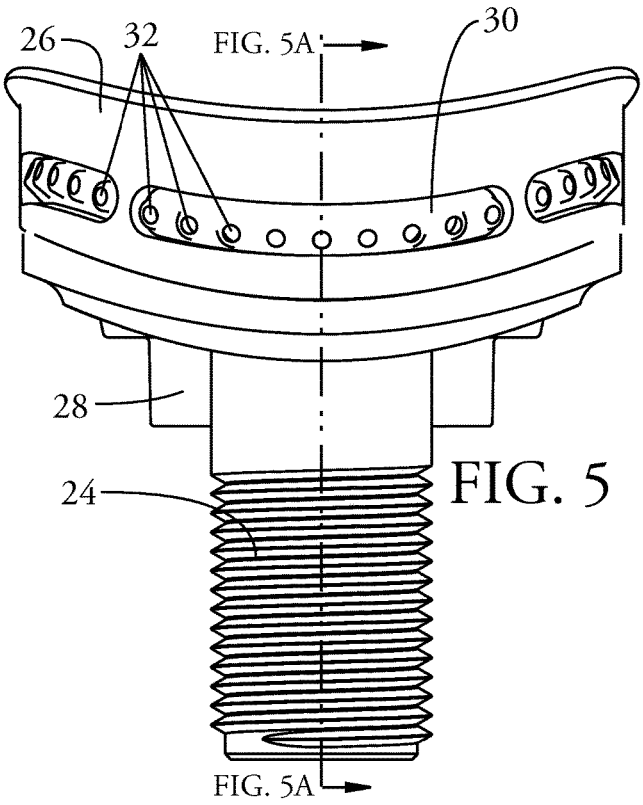
FIG. 5 is a front view of the urinal spreader assembly shown in FIG. 4.
Figure 5A:
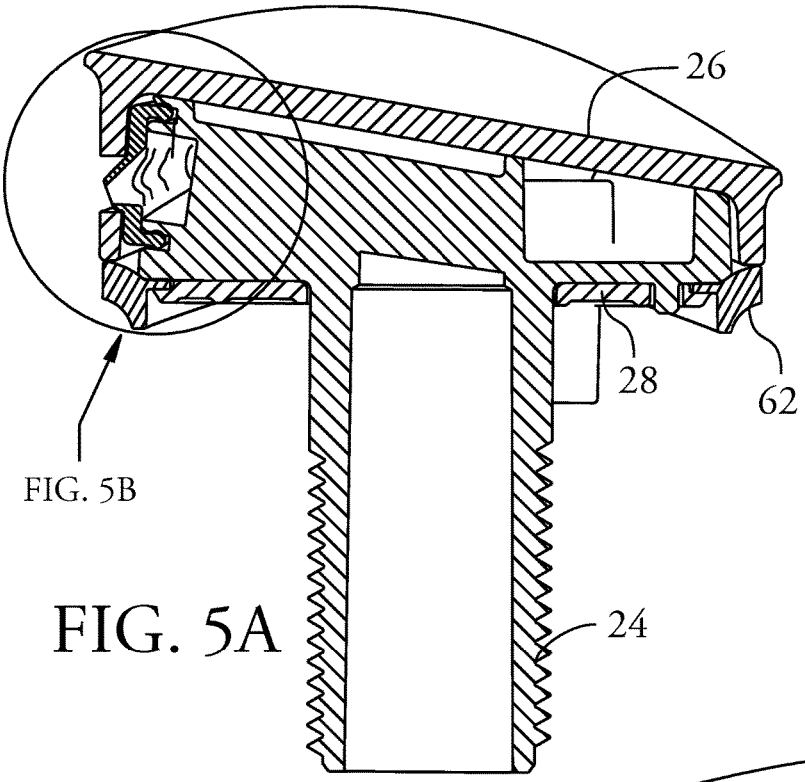
FIG. 5A is a cross-sectional view of the urinal spreader assembly shown in FIG. 5.
Figure 5B:
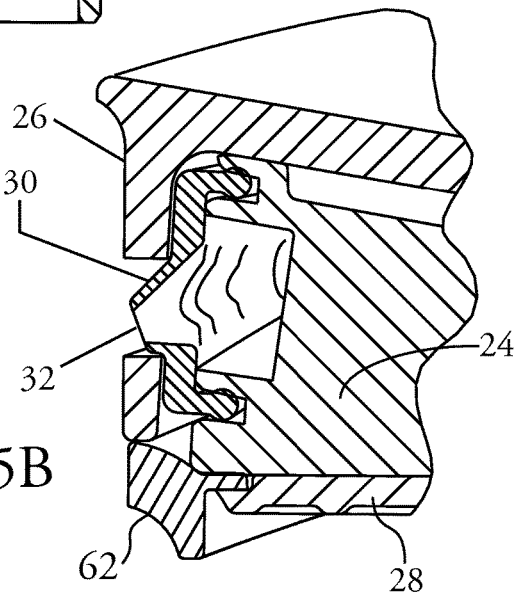
FIG. 5B is a detail view of the urinal spreader assembly shown in FIG. 5A.

FIGS. 4-5B illustrate an exemplary embodiment of the spreader assembly 16, which is configured to be coupled to the urinal 10. The spreader assembly 16 is shown to include a spreader body 24 (e.g., a body, member, housing, manifold, etc.), a spreader cover 26 (i.e., cover, lid, top, etc.), a spreader bottom 28 (e.g., a bottom, member, panel, etc.), and a spreader mat 30 (e.g., a mat, sprayer mat, spreader/sprayer piece, etc.), each of which will be described in greater detail below.

Figure 6:
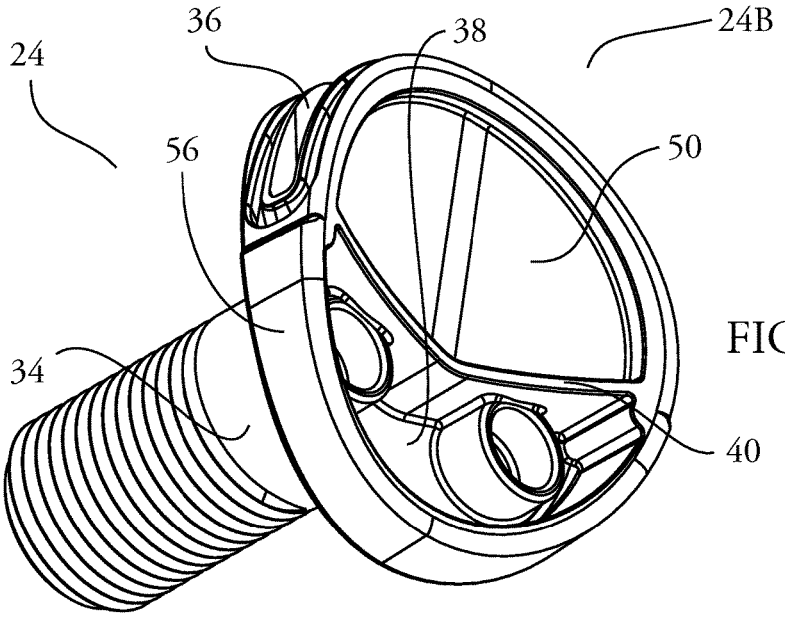
FIG. 6 is a perspective view of a body of the spreader assembly shown in FIG. 4.

FIGS. 6-8A illustrate an exemplary embodiment of a spreader body 24. The spreader body 24 may be made from a variety of materials, such as a polymeric material, a metal, or any other suitable material. As shown in FIG. 6, a rear end 24A of the spreader body 24 includes a tube 34, an outer portion of which is threaded. The tube 34 is configured to be received by a basin hole disposed within a wall (e.g., a rear wall) of a urinal (see, e.g., FIGS. 3-3A), and the threaded portion of the tube 34 is configured to extend through such a hole to a rear side of the urinal 10 opposite the basin 12. When the basin hole receives the tube 34, a fastener may be used on the threaded portion of the tube to secure the spreader body 24 to the urinal 10. Referring to FIG. 5A, a sealing member (e.g., a gasket, o-ring, or any other suitable sealing member) 62 may be provided between the spreader body 24 and the urinal 10 when the spreader body 24 is mounted thereto.

Figure 7:
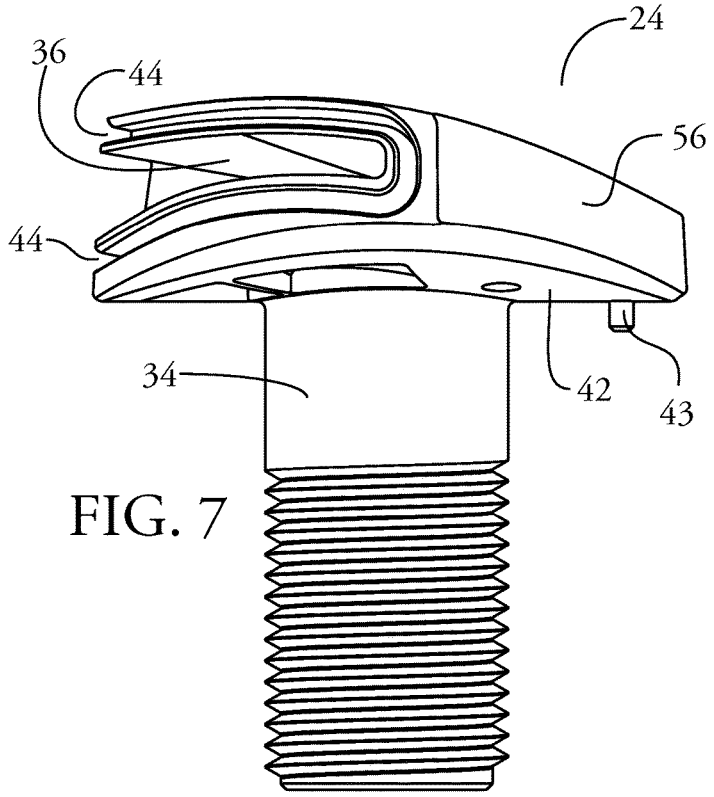
FIG. 7 is a side view of the body shown in FIG. 6.

According to an exemplary embodiment, a head portion 24B of the spreader body 24 is wider than the basin hole, and is configured to be coupled to the basin 12 when the tube 34 is received by the basin hole. For example, a rear wall 42 (not shown in FIG. 6, but see, e.g., FIG. 7) of the head portion 24B may be configured to abut against (e.g., rest against, engage against, etc.) the basin 12. In other words, a curvature of the rear wall 42 may be configured to be coupled to the basin 12. As shown in FIGS. 6-8, the head portion 24B of the spreader body 24 is generally round (e.g., cylindrical, dish-shaped, etc.). However, the head portion 24B could have alternative configurations (e.g., rectangular, polygonal, etc.), according to other embodiments, and the shape of the spreader body 24 shown in the FIGURES is not intended to be limiting.

Figure 8A:
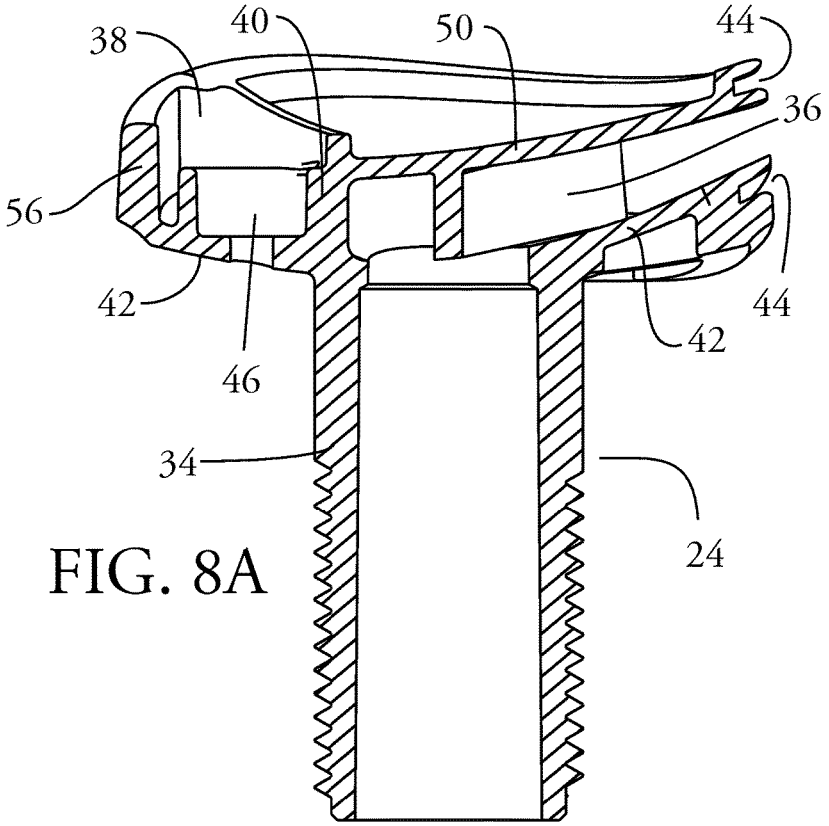
FIG. 8A is a cross-sectional view of the body shown in FIG. 8.
Figure 8:
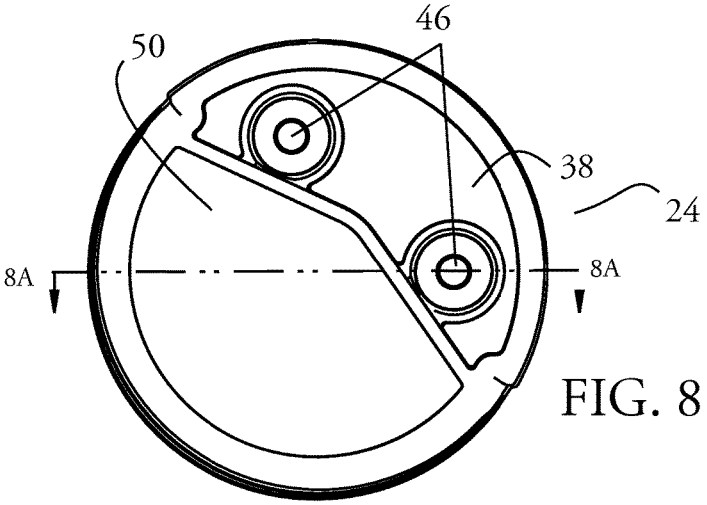
FIG. 8 is a top view of the body shown in FIG. 6.

As shown in FIGS. 6 and 8A, the head portion 24B of the spreader body 24 includes two primary chambers, (e.g., spaces, sections, areas, etc.) such as a water chamber 36 and a fastener chamber 38, which are shown to be separated by an interior wall 40. The water chamber 36 is configured to be fluidly coupled to (i.e., in fluid communication with) the tube 34 and the flush valve (not shown), when the spreader body 24 is mounted to the basin 12 and coupled to the hose 20. In other words, when the flush valve is actuated, water from a municipal water source may flow freely through the flush valve, the hose 20, the tube 34, and into the water chamber 36.

As shown in FIGS. 6-8A, according to an exemplary embodiment, when the spreader body 24 is mounted to a urinal 10 (e.g., as shown in FIGS. 1-3A), the water chamber 36 is bounded on a top side by the interior wall 40, on a rear side by the rear wall 42, and on a front side by a front wall 50. A bottom side of the water chamber 36 is left open (i.e., the bottom side is openly disposed). Thus, when the spreader body 24 is mounted to a urinal 10 and coupled to the hose 20 (as shown in FIG. 3A), and a flush valve (not shown) is actuated, flush water is directed (e.g., channeled) to the bottom side of the water chamber 36.

Referring still to FIGS. 6-8A, according to an exemplary embodiment, the fastener chamber 38 is positioned above the water chamber 36 when the spreader body 24 is mounted to the urinal 10. Further, the fastener chamber is configured to receive a plurality of fasteners (not shown, but e.g., screws, bolts, etc.), which are used to couple the spreader body 24 to the spreader bottom 28 and the spreader cover 26. For example, referring particularly to FIGS. 8-8A, according to an exemplary embodiment, the fastener chamber 38 includes two mounting holes 46 that are configured to receive such fasteners. The two mounting holes 46 are disposed within the rear wall 42, and a rear portion of each mounting hole 46 is configured to be coupled to the spreader bottom 28. A front portion of each mounting hole 46, which is positioned forward of the rear wall 42, is countersunk in order to receive a mounting member of the spreader cover 26 (this is explained in greater detail below). Assembly of the spreader bottom 28 and the spreader cover 26 to the spreader body 24 will be explained in greater detail below.

Figure 17:
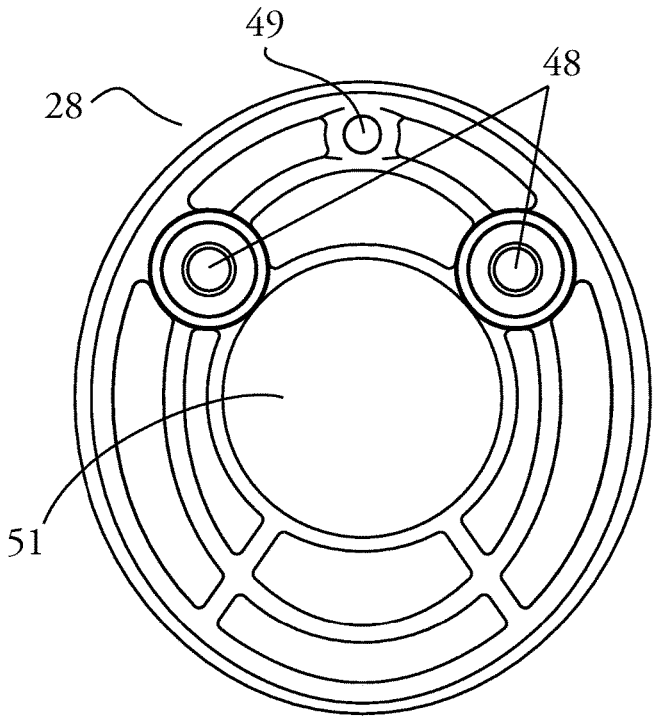
FIG. 17 is a rear view of the back piece shown in FIG. 16.

Referring now to FIG. 7, according to an exemplary embodiment, the water chamber 36 and the fastener chamber 38 may each comprise portions of the rear wall 42. A rear side of the rear wall 42 is configured to be coupled to the spreader bottom 28. Also, the rear side of the rear wall 42 may include a barrel 43 (e.g., a lug, member, tab, etc.), which may be used with a corresponding divot 49 (not shown in FIG. 7, but see, e.g., FIG. 17) on the spreader bottom 28 in order to position (e.g., align, orient, etc.) the spreader body 24 thereto.

Referring now to FIGS. 6 and 8A, according to an exemplary embodiment, the front wall 50 is provided in front of the water chamber 36 opposite the rear wall 42. The interior wall 40 is provided between the front wall 50 and the rear wall 42 of the water chamber 36, and forms a top side of the water chamber 36 when the spreader body 24 is mounted to the urinal 10. According to an exemplary embodiment, the spreader body 24 includes a side wall 56, and a portion of the side wall 56 proximate the water chamber 36 is configured to be coupled to the spreader mat 30. For example, as shown in FIGS. 7 and 8A, a channel 44 (i.e., groove, recession, slot, etc.) is formed within the side wall 56 of the spreader body 24. Although not completely depicted in FIGS. 7 and 8A, the channel 44 may wrap around a perimeter of the bottom side of the water chamber 36. Further, the channel 44 may define an opening within the bottom side of the water chamber 36, such that the spreader body 24 is openly disposed between the water chamber 36 and the channel 44. Referring now to FIGS. 5B and 10I, the channel 44 is configured to receive a sealing feature 54 provided on the perimeter of the spreader mat 30. Thus, a watertight seal may be formed between the spreader body 24 and the perimeter of the spreader mat 30, and flush water is directed to spray holes 32 within the spreader mat 30. The flow of water through the water chamber 36 and the spreader mat 30 is explained in greater detail below.

Figure 10:
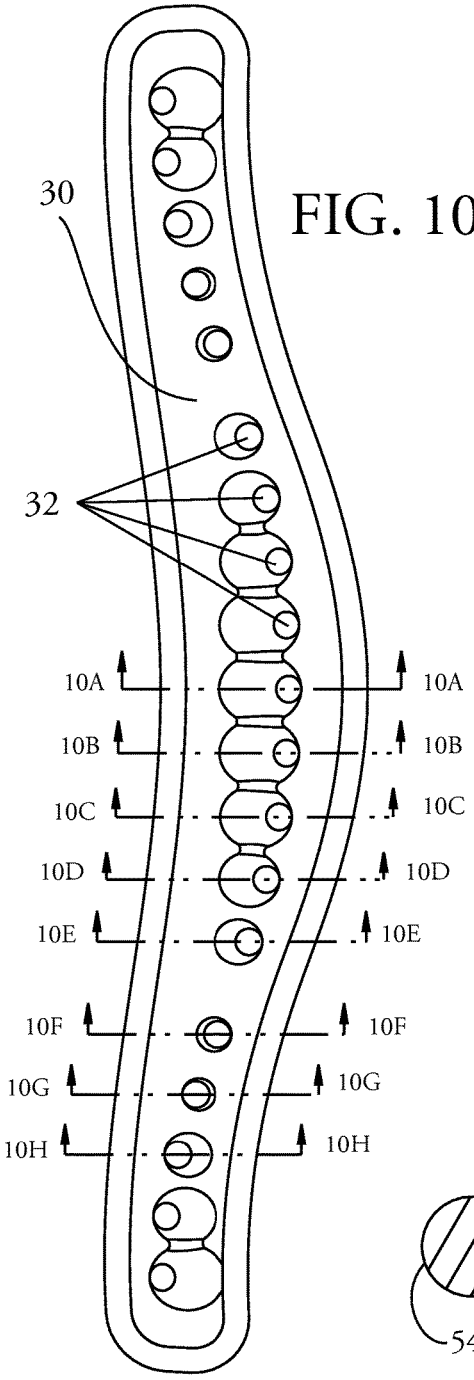
FIG. 10 is a rear view of the sprayer mat shown in FIG. 9.
Figure 10A:
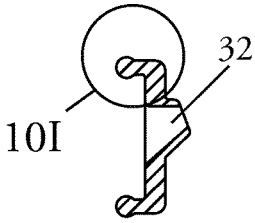
FIG. 10A is a cross-sectional view of an individual outlet of the sprayer mat shown in FIG. 10, according to an exemplary embodiment.
Figure 10B:
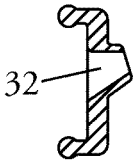
FIG. 10B is another cross-sectional view of an individual outlet of the sprayer mat shown in FIG. 10, according to an exemplary embodiment.
Figure 10C:
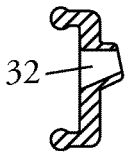
FIG. 10C is another cross-sectional view of an individual outlet of the sprayer mat shown in FIG. 10, according to an exemplary embodiment.

FIGS. 9-12 illustrate an exemplary embodiment for a spreader mat 30, which may be made from a material that has a soft durometer, such as silicone, rubber, neoprene, or any other suitable material. According to an exemplary embodiment, the spreader mat 30 is configured to be flexible. For example, FIG. 9 depicts a spreader mat 30 that is formed into a "C" shape, and FIGS. 10-12 depict the spreader mat 30 in a flat configuration. According to an exemplary embodiment, the material used to form the spreader mat 30 is also resistant to chloramine, fouling, and various household cleaners that may be used to clean a urinal. As shown in FIGS. 9-12, several spray holes 32 (i.e. outlet holes, discharge holes, apertures, orifices, etc.) are disposed in a linear fashion within a central portion of the spreader mat 30, but, according to other exemplary embodiments, the spray holes 32 could be arranged in any suitable pattern/fashion. Advantageously, as will be explained in even greater detail below, the pattern of the spray holes 32 may be configured for a shape of a particular urinal.

Referring to FIGS. 10A-10H, according to an exemplary embodiment, each spray hole 32 is configured to have a unique alignment (i.e., an aperture of each spray hole is oriented in a particular direction, or at a particular angle). The size, shape, alignment, and/or orientation of each spray hole 32 may be configured to direct a particular amount of flush water to a particular area or portion of the basin 12. As a result, the configuration of the spray holes 32 within the spreader mat 30 may be tailored to accommodate a urinal having a particular shape in order to maximize the coverage (i.e., the overall surface area of the basin upon which the spray holes direct flush water) while minimizing flow (i.e., the flow rate of flush water needed to effectively wash a usage area of the urinal). It should be understood that while the FIGURES illustrate the spreader mat having a certain number of spray holes that are aligned and oriented in a particular way, the spreader mat may include a fewer or greater number of spray holes which are aligned differently and oriented in other directions, and those examples disclosed herein are not limiting.

According to an exemplary embodiment, a spreader mat 30 may include one elongated spray hole that extends between a left and right side of the spreader mat. For example, various portions of the elongated spray hole may be aligned (e.g., angled) in a particular direction in order to direct flush water to a specific part of a basin of a urinal. Also, the height of the elongated spray hole may be consistent across its length. Alternatively, the height of the elongated spray hole may vary across its length in order to provide a different flow rate of water to different parts of the basin.

Figure 10D:
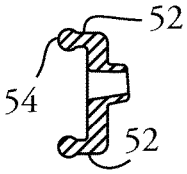
FIG. 10D is another cross-sectional view of an individual outlet of the sprayer mat shown in FIG. 10, according to an exemplary embodiment.
Figure 10E:
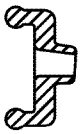
FIG. 10E is another cross-sectional view of an individual outlet of the sprayer mat shown in FIG. 10, according to an exemplary embodiment.
Figure 10F:
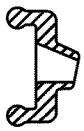
FIG. 10F is another cross-sectional view of an individual outlet of the sprayer mat shown in FIG. 10, according to an exemplary embodiment.
Figure 10G:
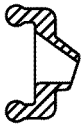
FIG. 10G is another cross-sectional view of an individual outlet of the sprayer mat shown in FIG. 10, according to an exemplary embodiment.
Figure 10H:
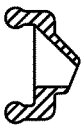
FIG. 10H is another cross-sectional view of an individual outlet of the sprayer mat shown in FIG. 10, according to an exemplary embodiment.
Figure 10I:
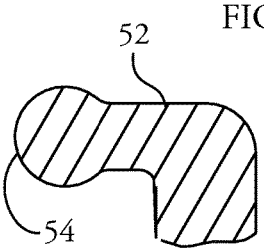
FIG. 10I is a detail view of a portion of the outlet shown in the cross-sectional view of FIG. 10A, according to an exemplary embodiment.

Referring to FIGS. 10A-10H, and more particularly to FIG. 10I, according to an exemplary embodiment, a perimeter of the spreader mat 30 is configured to form a watertight seal with the water chamber 36 when it is coupled to the spreader body 24, such that flush water may flow through the spreader body 24 and through the spray holes 32. As shown in FIGS. 10D and 10I, a flange 52 extends upward from the perimeter of the spreader mat 30. An end of the flange 52 includes a radial feature 54, and this feature 54 is configured to be received within the channel 44 of the spreader body 24. According to an exemplary embodiment, a watertight seal is formed between the radial sealing feature 54 of the spreader mat 30 and the channel 44 when the sealing feature 54 is received therein. Because a watertight seal is formed between the spreader mat 30 and the spreader body 24, flush water is constrained to flow out from the spray holes 32, each of which is oriented in a particular direction. Therefore, the spreader assembly 16 is configured so that flush water flows only where it is intended to flow (or, in contrast, flush water does not flow where it is not intended to flow). It is noted that other ways of providing a watertight seal between the spreader mat 30 and the spreader body 24 may be used, and that those examples disclosed herein are not limiting. For example, a separate sealing member, such as a gasket or an o-ring, may be provided between the mat 30 and the spreader body 24.

A spreader assembly, such as the spreader assembly 16, may need to be cleaned on a periodic basis. For example, the mineral content of some municipal water supplies may, over time, clog the spray holes 32 of the spreader mat 30. According to an exemplary embodiment, a user may use a brush, cloth, or any other suitable tool to scrub (i.e., brush, wipe, clean, etc.) any sediment or deposits that may accumulate on the spreader mat 30. According to an exemplary embodiment, the spreader mat 30 may be configured to be detachable from the spreader body 24 for cleaning. According to another exemplary embodiment, the spreader mat 30 may be configured to be replaceable. For instance, the spreader mat 30 may be configured so that a user is able to easily detach the spreader mat 30 from the channel 44 by pulling the spreader mat 30 from the channel 44. The spreader mat 30 may also be configured so that a user is able to easily attach the spreader mat 30 within the channel 44 by pushing the sealing feature 54 into the channel 44.

According to an exemplary embodiment, the spreader mat 30 of the spreader assembly 16 may be an interchangeable part, and a variety of spreader mats may be configured for a variety of urinals, each of which may have a basin of a particular shape and size. For example, the tube 34 may be configured to be received within a basin hole having standard size which is disposed within a wall of a variety of urinals. Therefore, a spreader body 24 that includes a standard tube 34 may be used on a variety of urinals. Likewise, a spreader mat 30 may have a spray hole pattern and configuration which is designed for a particular urinal, as well as a radial sealing feature 54 that engages the standard spreader body 24 (or a specific spreader body). One skilled in the art will appreciate that the design of the spreader assembly 16 may be less expensive than designing a typical urinal spreader for a particular urinal. For example, the tooling costs of designing a separate urinal spreader for a particular urinal may be quite substantial. In contrast, the costs of providing an improved universal spreader assembly 16 for a newly designed urinal that includes a basin having a particular shape may be comparatively less by fitting a standard spreader body (i.e., one in which the tooling costs have already been absorbed by a previous urinal model) with an inexpensive interchangeable spreader mat 30 that is tailored for the new urinal.

Figure 13:
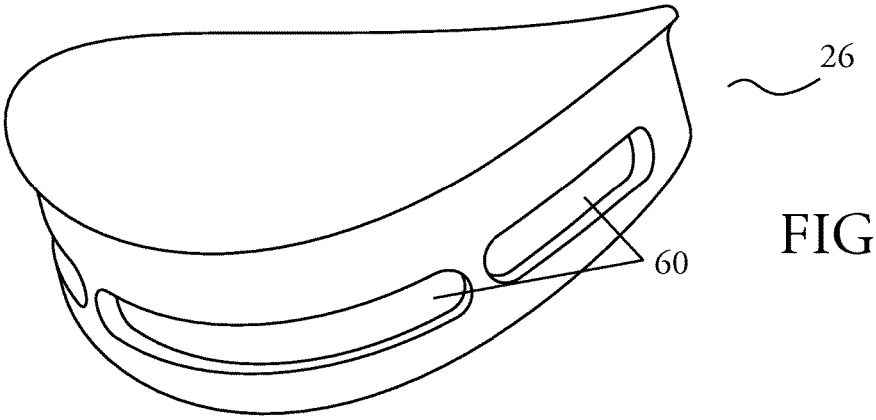
FIG. 13 is a perspective view of a cover of the spreader assembly shown in FIG. 4.
Figure 14:
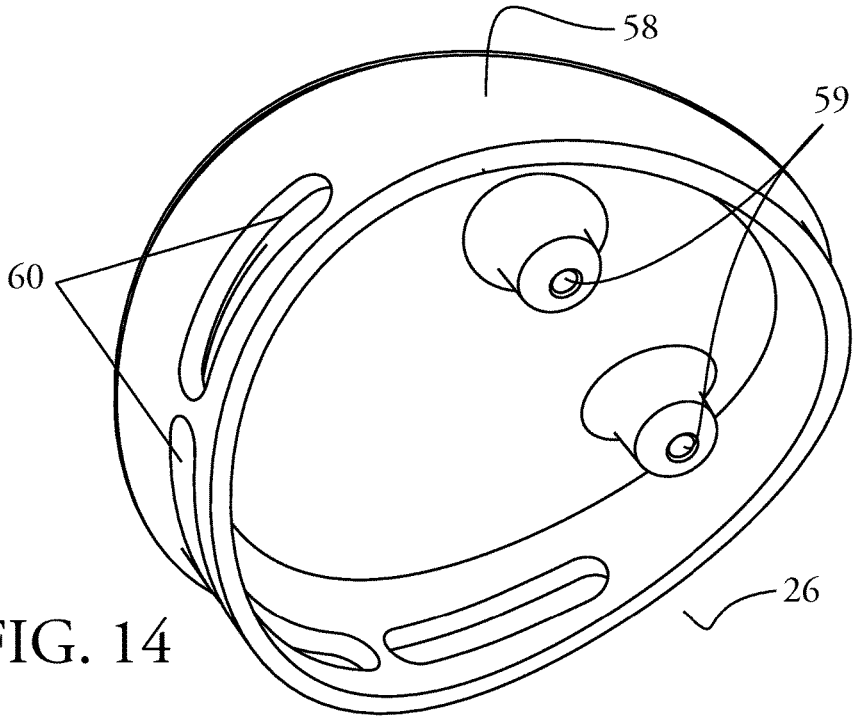
FIG. 14 is another perspective view of the cover shown in FIG. 13.
Figure 15:
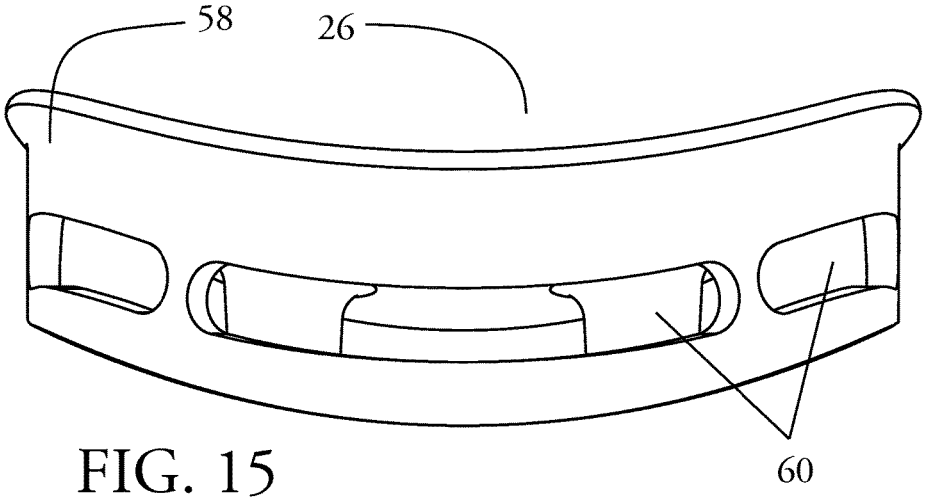
FIG. 15 is a front view of the cover shown in FIG. 13.
Figure 16:
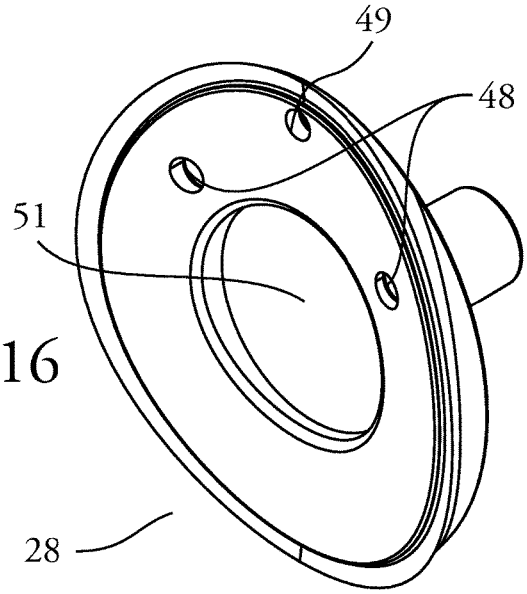
FIG. 16 is a perspective view of a back piece of the spreader assembly shown in FIG. 4, according to an exemplary embodiment.

FIGS. 13-15 illustrate an exemplary embodiment of a spreader cover 26 (i.e., a retainer, etc.). The spreader cover 26 may be formed from a variety of materials, such as a polymeric material, a composite material, a metal, or any other suitable material. According to an exemplary embodiment, the spreader cover 26 is configured to fit over the perimeter of the spreader body 24. When the spreader cover 26 is coupled to the spreader body 24, a front wall of the cover 26 is positioned in front of the water chamber 36 and the fastener chamber 38. Also, a side wall 58 of the spreader cover 26 is positioned radially exterior to the water chamber 36 and the fastener chamber 38. Referring to FIG. 14, two receptors 59 extend outwardly from a rear side of the spreader cover 26. According to an exemplary embodiment, each receptor 59 is configured to be received within a mounting hole 46 of the spreader body 24. Further, each mounting receptor 59 is configured to receive a fastener (not shown) in order to secure (e.g., fasten, hold, couple, etc.) the spreader cover 26 to the spreader body 24. According to another exemplary embodiment, the spreader cover 26 and the spreader body 24 may be cooperatively configured to be snap-fit together. Those skilled in the art will understand that the spreader cover 26 may be coupled to the spreader body 24 in other way, according to other exemplary embodiments, and that the disclosure herein is not limiting.

Referring still to FIGS. 13-15, according to an exemplary embodiment, a plurality of openings 60 (i.e., slots, holes, apertures, etc.) are disposed within a bottom portion of the side wall 58 of the spreader cover 26. According to an exemplary embodiment, the spreader cover 26 is configured to hold (i.e., retain, secure, etc.) the spreader mat 30 against the spreader body 24, and each opening 60 within the spreader cover 26 is configured to be positioned over a section of spray holes 32 of the spreader mat 30, in order to maintain the watertight relationship therebetween. According to an exemplary embodiment, a portion of the side wall 58 of the spreader cover 26, which is provided between two adjacent openings 60, may force the spreader mat 30 against the spreader body 24. According to an exemplary embodiment, the spreader mat 30 may include flanges (not shown) which extend outwardly slightly from a front surface of the spreader mat 30. Such flanges may be configured to fit within the openings 60 of the spreader cover 26. Although the FIGURES illustrate the side wall 58 of the spreader cover 26 as having a three openings 60, it is noted that the spreader cover 26 may have a fewer or greater number of openings 60, and that those examples disclosed herein are not limiting.

According to an exemplary embodiment, a front surface of the spreader cover 26 may be configured to have an aesthetic appearance. For example, the front surface of the spreader cover 26 may include a particular finish (e.g., chrome, brushed metal, etc.).

FIGS. 16-18B illustrate an exemplary embodiment for a spreader bottom 28. The spreader bottom 28 may be formed from a variety of materials, such as a polymeric material, a metal, a composite material, or any other suitable material. According to an exemplary embodiment, the spreader bottom is configured to be coupled to the rear wall 42 of the spreader body 24. For example, a body of the spreader bottom 28 may generally correspond to the rear wall 42. Also, the spreader bottom 28 includes a central bore 51 (e.g., hole) which is configured to be received by the tube 34. A divot 49 may be disposed within a body of the spreader bottom 28, and the divot 49 may be configured to receive the barrel 43 of the spreader body 24 in order to facilitate positioning of the spreader bottom 28 thereto. A plurality of mounting holes 48 are disposed within the body of the spreader bottom 28. As shown in FIG. 18B, the mounting holes 48 are countersunk within a rear side of the spreader bottom 28. According to an exemplary embodiment, the mounting holes 48 are configured to align with the mounting holes 46 of the spreader body 24 and the receptors 59 of the spreader cover 26 when the spreader bottom 28 and the spreader cover 26 are coupled to the spreader body 24.

Figure 19:
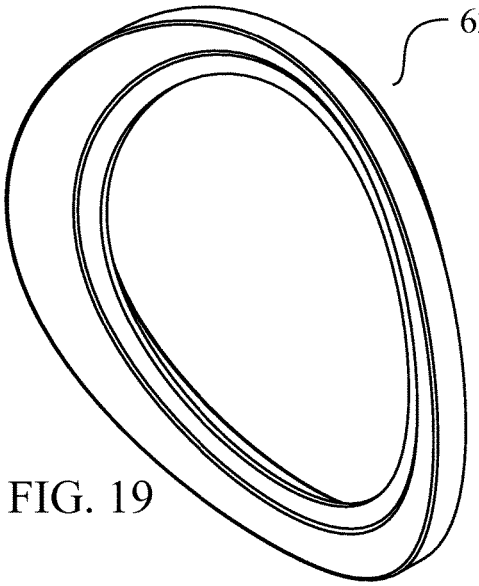
FIG. 19 is a perspective view of a seal, according to an exemplary embodiment.
Figure 20A:
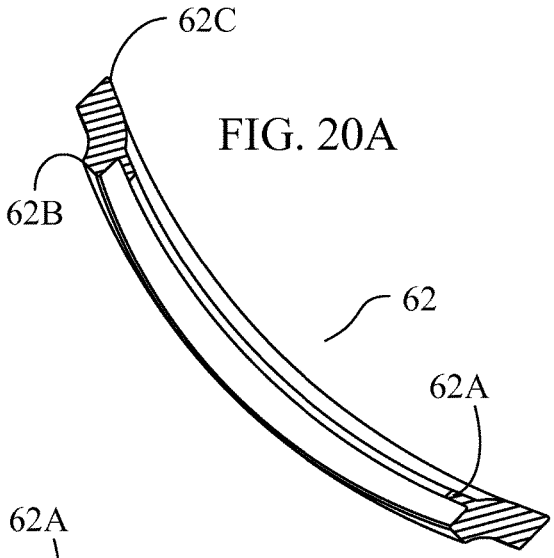
FIG. 20A is a cross-sectional view of the seal shown in FIG. 20.
Figure 20:
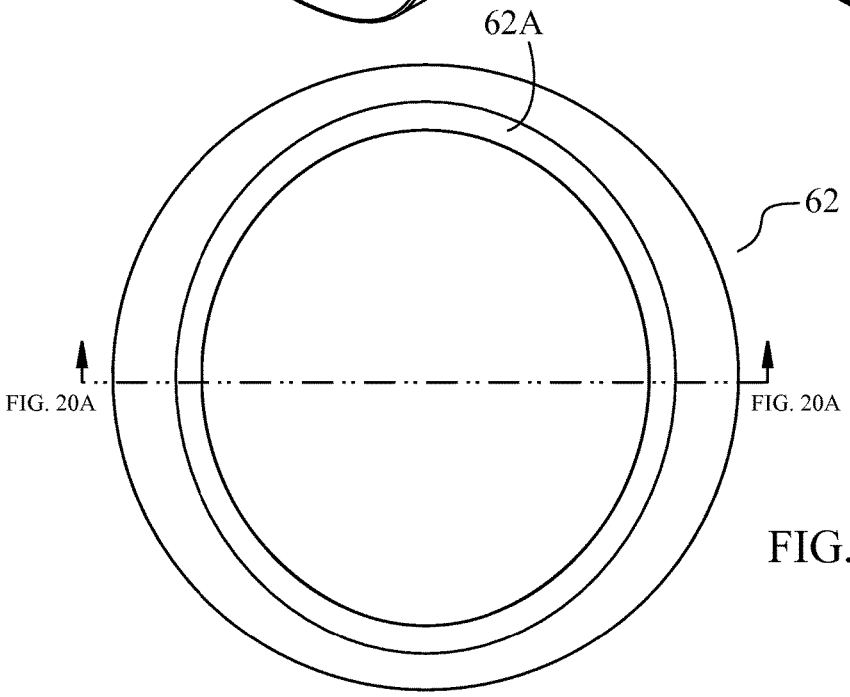
FIG. 20 is a front view of the seal shown in FIG. 19.

Referring now to FIGS. 19-20A, according to an exemplary embodiment, a seal 62 (e.g., a gasket, seal member, o-ring, etc.) is shown. The seal 62 is generally round, and includes a cross-sectional profile as shown in FIG. 20A. As shown in FIG. 20A, the seal 62 may be comprised of a front end 62C, a rear end 62B, and a flange 62A. The flange 62A is provided between the front and rear ends 62B, 62C, and extends inwardly circumferentially from a convex, inner radial surface of the seal 62. Referring now to FIGS. 5A and 5B, the flange 62A is configured to be positioned between the spreader bottom 28 and the spreader body 24. Accordingly, the flange 62A creates a watertight seal between the spreader bottom 28 and the spreader body 24. Further, a rear end 62B of the seal 62 may be configured to engage the basin 12, thus creating a watertight seal between the spreader assembly 16 and the urinal 10. As shown in FIGS. 5A and 5B, a front end 62C of the seal 62 may be configured to engage the spreader cover 26, thus creating a watertight seal between the spreader cover 26 and the urinal 10.

According to an exemplary embodiment, a method of assembling the spreader assembly 16 may include coupling the spreader bottom 28 to the rear wall 42 of the spreader body 24, and positioning the spreader cover 26 over the water chamber 36 and the fastener chamber 38. Next, a fastener (not shown), such as a threaded bolt or a screw, may be received by each mounting hole 48, and extend through a mounting hole 46 and a receptor 59 of the cover 26, thereby fastening (i.e., securing, holding, etc.) the spreader bottom 28 and the spreader cover 26 to the spreader body 24. The tube 34 of the spreader assembly 16 may then be received by a basin hole within the urinal 10, and secured thereto. It should be understood that other methods may be used to assemble the spreader assembly 16, according to other exemplary embodiments, and the systems and methods disclosed herein are not limiting. For example, the spreader body 24, the spreader cover 26, and/or the spreader bottom 28 may be configured to have a "snap-fit," press-fit, or any other suitable arrangement. Alternatively, adhesives may be used to couple the spreader body 24, the spreader cover 26, and/or the spreader bottom 28.

One skilled in the art will appreciate that, unlike other urinal spreaders, which direct flush water into a urinal in a general manner (i.e., there is a single slot, which is not necessarily designed for a particular urinal, from which flush water can flow out), the spreader assembly 16 is configured to direct all of the flush water used for a flush cycle toward particular areas of the basin 12, thereby ensuring an efficient (i.e., a smaller amount of flush water may be used) and effective (i.e., coverage may be maximized) flush cycle. This design is especially advantageous in view of the current global need to conserve water.

According to one exemplary embodiment, the spreader assembly 16 is shown to include the spreader body 24 which is coupled to the urinal 10, and which provides a structure for the other components (i.e., elements, parts, etc.) of the spreader assembly 16 to couple thereto. Because the other components of the spreader assembly 16 are coupled to the spreader body 24, the orientation of the spreader body 24 ultimately affects the orientation of these other components with respect to the urinal 10. The spreader assembly 16 is also shown to include a spreader mat 30, which is provided with several apertures 32 which flush water may flow therethrough. The spreader assembly 16 also includes a spreader cover 26, which may have functional utility (i.e., to retain the spreader mat 30 in a sealed relationship with the spreader body 24), as well as aesthetic purposes. The spreader assembly 16 also includes a spreader bottom 28 which is used in conjunction with fasteners to fasten (i.e., secure, hold, couple, etc.) the spreader cover 26 to the spreader body 24. Overall, the various components of the spreader assembly 16 provide an adaptable solution for creating different rinse water discharge/distribution profiles for different urinal designs/models by using a standard body and an interchangeable spreader.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the attachments having bumper assemblies as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A spreader assembly for a urinal, comprising:

a spreader body configured to be fluidly coupled to a water supply and coupled to the urinal, the spreader body comprising:

a front wall having a first portion of a channel in an end thereof; and a rear wall separated and offset from the front wall by a water chamber, the rear wall having a second portion of the channel in an end thereof;

wherein an opening into the water chamber is defined at least in part by the end of the front wall having the first portion of the channel and the end of the rear wall having the second portion of the channel; and a spreader mat that is disposed in the opening and is coupled to the spreader body, the spreader mat comprising:

a flange having a plurality of spray holes; and a seal, a first portion of the seal extending radially from the flange and engaging the first portion of the channel, and a second portion of the seal extending radially from the flange and engaging the second portion of the channel;

wherein when flush water is supplied to the spreader body, the flush water flows through the water chamber and from the spray holes within the spreader mat; and wherein in an installed position with the urinal, each spray hole of the spreader mat is oriented toward a particular area of the urinal in order to direct flush water thereto.

2. The spreader assembly of claim 1, wherein the spreader mat is silicone.

3. The spreader assembly of claim 1, wherein a perimeter of the spreader mat is configured to be sealingly coupled to the spreader body, the spreader mat has a C-shape relative to a longitudinal axis of the spreader body, and each spray hole of the spreader mat is aligned at a different radial direction along the C-shape in order for each spray hole.

4. The spreader assembly of claim 1, further comprising a spreader cover that is configured to hold the spreader mat against the spreader body, wherein the spreader cover comprises an annular side wall that is located radially outward relative to the spreader body, and wherein at least one spray hole of the plurality of spray holes extends through an opening in the side wall.

5. The spreader assembly of claim 4, further comprising a spreader bottom that is configured to be coupled to a rear side of the spreader body, when the spreader body is coupled to the urinal;

wherein the spreader bottom, the spreader body, and the spreader cover are cooperatively configured to be fastened together; and wherein the side wall includes a plurality of semi-annular elongated openings and a set of the plurality of spray holes extends through each opening of the plurality of semi-annular elongated openings.

6. The spreader assembly of claim 1, wherein the spreader body further comprises a head portion having a water chamber;

wherein when water flows from the water supply to the spreader body, the water enters the water chamber before flowing out of the spray holes of the spreader mat.

7. The spreader assembly of claim 1, wherein the spreader mat is flexible, and the spreader mat is a first spreader mat that is configured to be interchangeable with a second spreader mat for use with a second urinal, where the second spreader mat has a plurality of spray holes having different alignments than the plurality of spray holes of the first spreader mat and the second urinal has a basin having a different shape than a basin of the first urinal.

8. The spreader assembly of claim 1, further comprising a spreader cover that is configured to hold the spreader mat against the spreader body by having a first portion of the spreader mat retained between the spreader cover and the front wall and a second portion of the spreader mat retained between the spreader cover and the rear wall, wherein the spreader cover is coupled to the spreader body through a fastener.

9. The spreader assembly of claim 8, further comprising a spreader bottom that is configured to be coupled to a rear side of the spreader body, when the spreader body is coupled to the urinal;

wherein the spreader bottom, the spreader body, and the spreader cover are cooperatively configured to be fastened together with the fastener.

10. A spreader assembly for a urinal, the spreader assembly comprising:

a spreader body configured to be coupled to the urinal, the spreader body having a groove;

a spreader mat including:

a lip extending around a perimeter thereof, the lip being configured to engage the groove of the spreader body; and a plurality of apertures configured to disperse water in a predetermined pattern; and a spreader cover configured to retain the spreader mat position on the spreader body, the spreader cover comprising an annular side wall that is located radially outward relative to the spreader body, wherein the annular side wall includes a plurality of slots, and wherein a set of the plurality of apertures extends through each slot of the plurality of slots.

11. The spreader assembly of claim 10, wherein a water chamber of the spreader body is defined by a front wall of the spreader body, a rear wall of the spreader body that is spaced apart and separate from the front wall, the interior wall of a spreader body, and an inside of a spreader mat, wherein the water chamber is fluidly coupled to the water supply, and wherein the plurality of apertures are disposed linearly within a central portion of the spreader mat.

12. The spreader assembly of claim 11, wherein the spreader mat is located between an outer profile the front wall and an outer profile of the rear wall of the spreader body, so that each of the outer profile of the front wall, the outer profile of the rear wall and the spreader mat has a semi-circular shape.

13. The spreader assembly of claim 12, wherein the spreader mat comprises a silicone and has a generally C-shaped cross-section.

14. The spreader assembly of claim 10, wherein the spreader mat is configured to be attached to, and detached from the spreader body.

15. The spreader assembly of claim 10, wherein the spreader mat is flexible.

16. The spreader assembly of claim 10, wherein the spreader mat is silicone.

17. The spreader assembly of claim 10, wherein the spreader mat includes a flange having the plurality of apertures, wherein the annular side wall of the spreader cover is configured to hold the flange of the spreader mat against the spreader body, and wherein each aperture has a unique alignment relative to the flange compared to the other apertures of the plurality of apertures.

18. The spreader assembly of claim 17, further comprising a spreader bottom that is configured to be coupled to a rear side of the spreader body, when the spreader body is coupled to the urinal;

wherein the spreader bottom, the spreader body, and the spreader cover are cooperatively configured to be fastened together.

19. The spreader assembly of claim 10, wherein the engagement between the spreader mat and the spreader body forms a watertight seal.

* * * * *